United States Patent [19]

Verachtert

[11] Patent Number: 4,481,106

[45] Date of Patent: Nov. 6, 1984

[54] HYDROCARBON TREATING PROCESS

[75] Inventor: Thomas A. Verachtert, Wheeling, Ill.

[73] Assignee: UOP Inc., Des Plaines, Ill.

[21] Appl. No.: 558,243

[22] Filed: Dec. 5, 1983

[51] Int. Cl.[3] ..... C10G 19/00; C10G 19/02

[52] U.S. Cl. ..... 208/206; 422/239; 422/211; 208/203

[58] Field of Search ..... 208/206, 203; 422/239, 422/211

[56] References Cited

U.S. PATENT DOCUMENTS

| | | | |
|---|---|---|---|
| 2,176,806 | 10/1939 | Schuesster et al. | 208/203 |
| 2,729,591 | 1/1956 | Haresnape | 208/203 |
| 2,882,224 | 4/1959 | Gleim et al. | 208/206 |
| 2,988,500 | 6/1961 | Gleim et al. | 208/206 |
| 3,413,215 | 11/1968 | Beshears | 208/206 |
| 3,445,380 | 5/1969 | Urban | 208/206 |
| 3,547,354 | 12/1968 | Grealhouse | 422/211 |
| 3,574,093 | 4/1971 | Strong | 208/206 |
| 3,923,645 | 12/1975 | Anderson, Jr. et al. | 208/206 |
| 4,019,869 | 4/1977 | Morris | 23/288 R |
| 4,081,354 | 3/1978 | Christman | 208/206 |
| 4,142,964 | 3/1979 | Carlson et al. | 208/206 |
| 4,248,694 | 2/1981 | Carlson et al. | 208/209 |
| 4,392,947 | 7/1983 | Audeh et al. | 208/229 |

FOREIGN PATENT DOCUMENTS

| | | | |
|---|---|---|---|
| 625756 | 8/1961 | Canada | 268/206 |

OTHER PUBLICATIONS

Hydrocarbon Processing, Apr. 1982, p. 124, "Merox".

*Primary Examiner*—Delbert E. Gantz
*Assistant Examiner*—Helane E. Maull
*Attorney, Agent, or Firm*—William H. Page, II; Johh F. Spears, Jr.

[57] ABSTRACT

A process is disclosed for treating hydrocarbon streams such as naphtha by the oxidation of mercaptans into disulfide compounds which remain in the hydrocarbon stream. The conversion is effected during passage of the hydrocarbon and an aqueous stream downward through a cylindrical mass of liquid-liquid contact material. The liquids then flow through a cylindrical screen into an annular separation zone which surrounds a lower part of the contact material. After decantation in the separation zone, the aqueous material, which preferably contains the oxidation catalyst, is recycled.

16 Claims, 1 Drawing Figure

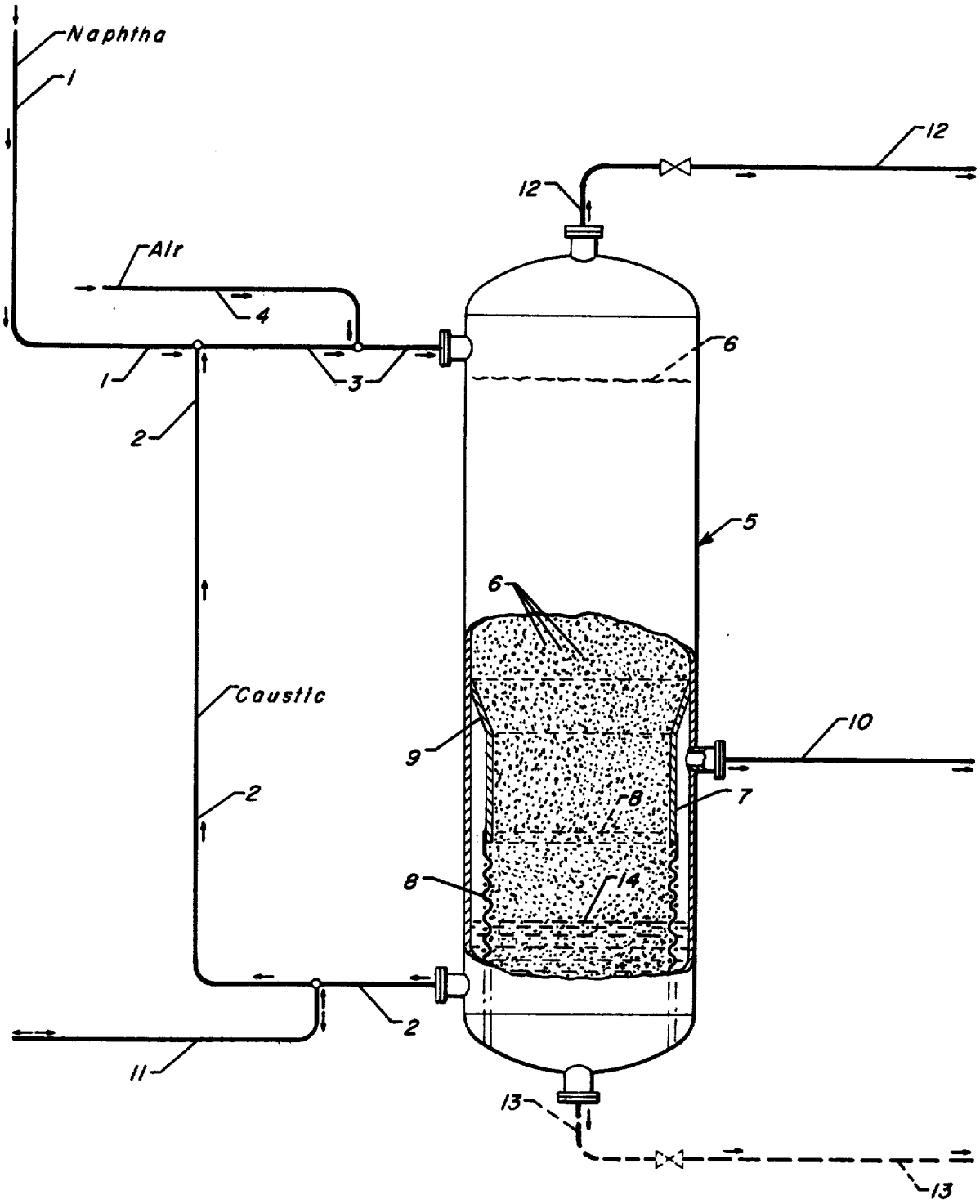
Naphtha
1
12
12
Air
4
6
1
3
2
5
6
Caustic
10
9
2
7
8
8
14
2
11
13
13

HYDROCARBON TREATING PROCESS

FIELD OF THE INVENTION

The invention relates to a mineral oil treating process referred to as sweetening. In this process, mercaptans present in a liquid hydrocarbon stream are oxidized to disulfide compounds which remain in the hydrocarbon stream. The invention therefore relates to processes for treating hydrocarbon streams such as naphtha or kerosene as are performed in petroleum refineries. The invention specifically concerns the method and apparatus used to bring the hydrocarbon stream and a circulating aqueous stream into contact and to then separate the hydrocarbonaceous and aqueous phases.

INFORMATION DISCLOSURE

The sweetening of sour petroleum fractions is a well developed commercial process which is employed in almost all petroleum refineries. In this process, mercaptans present in the feed hydrocarbon stream are converted to disulfide compounds which remain in the hydrocarbon stream. Sweetening processes therefore do not remove sulfur from the hydrocarbon feed stream but convert it to an acceptable form. The sweetening process involves the admixture of an oxygen supply stream, typically air, into the hydrocarbon stream to supply the required oxygen. An oxidation catalyst is also employed in the process. The oxidation catalyst may be a part of a solid composite or may be dispersed or dissolved in an aqueous alkaline solution. A commonly employed oxidation catalyst comprises a metal phthalocyanine compound. This preferred catalyst is described in U.S. Pat. No. 2,882,224. This reference is also relevant for its teaching of general processing conditions and methods. The process flow of a similar sweetening process is shown in U.S. Pat. No. 2,988,500. A sweetening process using a different catalyst system is disclosed in U.S. Pat. No. 3,923,645.

The process flow of two commercial sweetening processes is shown at page 124 of the April, 1982 issue of *Hydrocarbon Processing*. When a significant amount of the alkaline aqueous solution, commonly referred to as caustic, is employed on a continuous basis, the aqueous solution and the hydrocarbon stream are first passed through a reaction vessel containing a fixed bed of contacting material. The aqueous liquid is then normally separated from the hydrocarbon stream in a separate settling vessel. In the second process flow, a very small amount of the aqueous solution is charged to the reaction vessel. The aqueous solution is then withdrawn from the bottom of the reaction vessel. U.S. Pat. No. 4,019,869 illustrates an apparatus which may be used in the latter process. It is also pertinent for showing a cylindrical particle bed resting on a horizontal support as the contacting zone. It is believed that heretofore this type of particle bed configuration was employed in commercial sweetening processes.

U.S. Pat. No. 4,392,947 is pertinent for its disclosure that sweetening processes may be performed having the liquids flowing upward, downward or in radial flow through the particle bed of the reaction zone.

BRIEF SUMMARY OF THE INVENTION

The invention provides a sweetening process which is characterized by the performance of both the contacting step and the separation step in a single unitary vessel. In addition, the vessel has a simple and therefore low cost design. A distinguishing point of the new process is that the particle bed extends downward into a separation area, with a smaller diameter bottom portion of the particle bed being surrounded by a cylindrical wall having a lower porous section.

One embodiment of the invention may be characterized as a process for reducing the concentration of mercaptan compounds in a hydrocarbon stream which comprises the steps of contacting a liquid phase hydrocarbon feed stream which comprises mercaptans, a liquid phase first aqueous stream which comprises an alkaline reagent, and an oxygen supply stream in the presence of an oxidation catalyst in a fixed bed of contact material maintained at oxidation-promoting conditions and located within a vertically aligned vessel, the liquids flowing cocurrently downward through the bed of contact material from an upper portion of the vessel to a point in the lower one-third of the vessel; separating the liquids which have passed downward through the bed of contact material by a method which comprises passing at least the hydrocarbonaceous portion of the liquids horizontally through a porous vertical screen encircling a lower portion of the bed of contact material into a quiescent separation zone located in the bottom one-third of the vessel with the liquids dividing into an aqueous phase and a less dense hydrocarbon phase, which is collected in an open-bottomed chamber forming the top of the separation zone; withdrawing a treated hydrocarbon product stream comprising disulfide compounds from the separation zone; withdrawing a second aqueous stream at a point in the vessel below the open-bottomed chamber; and passing at least a portion of the aqueous recycle stream into the vessel for use as the previously referred to liquid phase aqueous stream.

BRIEF DESCRIPTION OF THE DRAWING

The drawing is a simplified illustration of a sweetening process in which a feed stream of naphtha carried by line 1 is treated by the conversion of mercaptans present in the feed stream to disulfide compounds. This drawing of the preferred embodiment of the process has been simplified by the deletion of much of the apparatus customarily employed on a process of this nature such as temperature and pressure control systems, flow control valves, recycle pumps, etc. which are not required to illustrate the performance of the subject process. This presentation of specific embodiments of the invention is not intended to preclude from the scope of the subject invention those other embodiments set out herein or reasonable and expected modifications to those embodiments.

Referring now to the drawing, the sour naphtha feed stream from line 1 is admixed with an aqueous alkaline solution referred to herein as caustic carried by line 2. The admixture of naphtha and caustic is transported through line 3. Air from line 4, the preferred oxygen source, is admixed into a liquid flowing through line 3 with the air becoming totally dissolved within the liquid phase material. The thus-admixed liquid phase reactants enter the vertical vessel 5 at an upper point above a fixed bed of contact material 6. The liquids with the dissolved oxygen flow downward through the contacting material. The contacting material may support a suitable oxidation catalyst to promote the desired conversion of the mercaptans. However, it is preferred that the catalyst is dissolved in the caustic. A circular imperforate support ring 9 located in a lower half of the vessel causes the bed of particulate material to taper to a smaller diameter cross-section. A cylindrical imperforate wall 7 extends downward from the lower edge of the ring 9 to thereby confine the particulate material to a smaller cylindrical volume in the center of the vessel. Below the wall 7, the bed of particulate material is confined to the same cylindrical shape by a porous screen 8. The cylinder formed by the wall 7 and screen 8 defines an annular void volume located between the outer surface of the wall 7 and screen 8 and the inner surface of the vessel. This volume is referred to herein as the annular separation zone.

As the liquids flow downward through the contacting material of the smaller diameter cylindrical section, they begin to separate into discrete aqueous and hydrocarbon phases. The aqueous liquid is collected in the bottom of the vessel 5 as an aqueous phase having an upper interface 14, with the hydrocarbonaceous liquid phase located above this level. The descending liquids eventually flow outward horizontally through the porous wall 8 into the annular separation zone. The hydrocarbons rise upward into the open-bottomed collection chamber located at the top of the annular separation zone. The treated naphtha is withdrawn from this open-bottomed volume through line 10 as the product stream of the process. The aqueous material is withdrawn through line 2 for recycling. Small portions of the caustic may be periodically removed or added through line 11 to maintain the desired caustic purity and concentration. In the embodiment of the subject process in which the alkaline aqueous solution is only added on an intermittent basis or at a very small rate, the aqueous material may be withdrawn from the bottom of the vessel 5 through line 13. A vent line 12 may be provided at the top of the outer vessel 5 with the withdrawal of any separate gas phase which forms within the vessel.

DETAILED DESCRIPTION

Most normally liquid hydrocarbon fractions produced in a petroleum refinery contain some sulfur compounds unless the hydrocarbon fraction has been subject to very extensive desulfurization procedures. The sulfur concentration in these fractions may be relatively low due to upstream refining operations such as hydrotreating. In many instances, such low total sulfur concentrations are acceptable in products such as motor fuel naphtha, kerosene or diesel fuel. However, the concentration of certain sulfur compounds must be very low to meet product specifications for these products. Specifically, the concentration of acidic and malodorous mercaptan compounds must be very low. The total removal of all sulfur-containing compounds can be very expensive. Therefore, it is a common practice to convert small amounts of mercaptan compounds to disulfide compounds, which because of their low vapor pressure and nonacidic nature, are tolerable in the hydrocarbon product, rather than to attempt to totally remove all sulfur compounds. This treating process is referred to as sweetening as it converts a "sour" smelling feedstock into a "sweet" smelling product, sometimes referred to as a "Doctor sweet" product owing to the "doctored" product passing a simple qualitative test indicating the absence of mercaptan compounds.

Sweetening is widely employed commercially as a low cost method of lowering the mercaptan content of normally liquid hydrocarbon products. In a typical commercial sweetening unit, the feed hydrocarbon is admixed with a gaseous oxygen supply stream and passed through a catalytic oxidation zone in which the mercaptans are oxidized to the corresponding disulfides. This reaction has also been referred to as oxidative condensation. Air is normally employed as the oxygen supply stream due to the greater cost of more highly concentrated oxygen-containing gases. An excess of oxygen above that required for the stoichiometric oxidation of the mercaptans is added to the hydrocarbon stream to promote the oxidation reaction.

An alkaline solution commonly referred to as caustic is also admixed into the hydrocarbon stream. This is either on a continuous or periodic basis. In those processes in which the alkaline solution is used on a continuous basis, it is necessary to obtain a degree of surface contact and admixture of the two phases. The passage of the hydrocarbon and aqueous caustic through the contacting zone can result in sufficient admixture of these two liquid phases to form a difficult to separate dispersion. It is highly undesirable, in almost all situations, for any of the aqueous material to remain in the hydrocarbon phase. The dispersion can be separated if a sufficient retention time is provided in a settling zone. Such zones however increase the cost of the process. It is an objective of the subject invention to provide a treating process which achieves sufficient contact of the aqueous and hydrocarbon phases but does not require the use of a separate large capacity separation vessel. It is also an objective of the subject invention to reduce the equipment costs and complexity of a sweetening process.

The subject process can be applied to the sweetening of any of various relatively light hydrocarbon fractions including naphtha and kerosene. Light straight run, light coker naphthas or similar fluid catalytically cracked products are specific examples of the preferred feed materials, which contain a mixture of hydrocarbons having boiling points under about 430° F. The feed stream may be derived from coal, petroleum, oil shale, etc. In the subject process, the admixture of the feed hydrocarbon and the alkaline solution, which is described in more detail below, are passed downward in a fixed bed of contacting material. The liquid is spread across the upper surface of the bed by a distributor. The upper portion, at least the upper one-half, of the bed of contacting material preferably has a cylindrical shape conforming to the inner surface of the process vessel. The liquids travel downward through the contacting material with the desired oxidative condensation of the mercaptans converting them into disulfide compounds. The disulfide compounds become dissolved in the hydrocarbon stream. At a point in the lower portion of the vessel, preferably in the lower one-third of the vessel, the two liquid phases are separated. This separation is performed at least in part within the contacting material. The separation begins when the vertical velocity of the liquids decreases because liquid is allowed to flow horizontally into a quiescent separation zone.

The separation zone is separated from the other portions of the vessel at the same level by at least one perforate panel or screen. This screen allows the free flow of liquid into the separation zone while preventing the entrance of contacting material. The hydrocarbons flow into the separation zone, and then flow upward due to the presence of a hydrocarbon outlet at the top of the separation zone. To accomplish this, the upper portion of the separation zone must be enclosed by a shroud or similar covering which can trap the less dense hydrocarbons. This forms an open-bottomed chamber at the top of the separation zone. This chamber must be sufficiently open at the bottom to allow the entrance of the hydrocarbons and to allow the denser aqueous alkaline solution to settle to the bottom of the vessel. Preferably, the separation zone is completely devoid of contacting material and extends downward to the bottom inner surface of the vessel.

The separation zone can be constructed with a number of different shapes. It could therefore have a rectangular cross-section and comprise a box-like structure centrally located in the bottom portion of the vessel. When viewed from above, the box-like structure could have a narrow rectangular cross-section extending across the entire distance between the inner surfaces of the vessel's outer wall. It is greatly preferred that the separation zone has the form of an annulus which surrounds a cylindrical bed of the contacting material. This cylindrical bed is preferably a continuation of the cylindrical contacting bed and extends downward through the vessel as shown in the drawing. It is also preferred that the annulus is located next to the inner surface of the outer vessel. This requires the use of only one porous wall and facilitates the withdrawal of liquid(s) directly through the vessel wall without the use of collection devices or connecting lines located within the vessel. Alternatively, an annular separation zone could be located radially inward from the outer wall of the vessel and have two cylindrical porous wall sections. The contacting material would then be present in an annular bed surrounding the separation zone in addition to being present as a cylindrical bed within the innermost wall of the annulus. The total cross-sectional area of the separation zone is less than 25 percent, and more preferably less than 20 percent, of the total cross-sectional area of the vessel on a horizontal section. It is therefore preferred that the remaining 75-plus percent of the cross-section of the vessel is filled with the contacting material.

The porous wall(s) of the separation zone are preferably made from a rigid self-supporting metal screen. This screen can be fabricated by welding parallel face rods to perpendicular support or connecting rods. The face rods should have a flat protruding surface which faces inward toward the contacting material. This material can be purchased from the Johnson Division of UOP Inc., New Brighton, Minn. The cylindrical screen preferably extends downward to the point at which it reaches the inner surface of the outer vessel. The remaining interior walls of the separation zone are formed of imperforate metal sheeting such as ¼-inch carbon steel. It is preferred that the bed of contacting material is supported by the eliptical bottom head of the vessel. A separate perforate screen at the bottom of the vessel is used to prevent the contacting material from passing out with drain liquid. As an aid to practicing the subject process, it may be observed that in a rather small but commercial scale design, the outer vessel had a 6-foot inner diameter and contained an 8-foot high bed of contacting material. The separation zone was annular as in the drawing. The imperforate cylindrical wall was about 12 inches in height and the porous cylindrical wall was about 22 inches in height. As the alkaline aqueous solution was to be injected at a very low rate in this instance, the outlet port for the aqueous material was at the bottom of the vessel. If a substantial amount (more than 2 vol. %) of aqueous liquid is passed into the vessel with the hydrocarbons, the outlet for the aqueous liquid preferably communicates with the internal volume of the separation zone at a point below the top of the porous wall.

The subject process may be characterized as a method for treating hydrocarbon streams which comprises the steps of forming a liquid-phase reaction zone charge stream by admixing a liquid phase hydrocarbon feed stream which comprises a mercaptan with a liquid phase first aqueous stream which comprises an alkaline reagent and a soluble oxidation catalyst and with an oxygen supply stream; passing the reaction zone charge stream downward through a fixed mass of contact material located within a vertically oriented vessel at oxidation-promoting conditions, the mass of contact material extending from an upper portion of the vessel downward to at least the lowermost quarter of the vessel; separating the liquids flowing downward through the mass of contact material in the lowermost quarter of the vessel by a method which comprises withdrawing the liquids through a vertical porous wall into an annular separation zone which is located in the lower portion of the vessel and surrounds the lower portion of the mass of contact material, and decanting the liquids into a hydrocarbon phase comprising disulfide compounds which rises into an open-bottomed covered volume, which is located above the porous wall and separated by impervious upper and side walls from the mass of contact material, and an aqueous phase comprising the alkaline reagent which settles to the bottom of the vessel; withdrawing a treated hydrocarbon product stream from the open-bottomed volume, and withdrawing a second stream of aqueous liquid from the lower portion of the vessel; and employing at least a portion of the second aqueous stream as the previously referred to first aqueous stream.

A mercaptan oxidation catalyst is employed in the subject process. This catalyst may be supported on a bed of inert solids retained within the oxidation zone or may be dispersed or dissolved in the aqueous alkaline solution. The use of catalyst present in a circulating aqueous solution has the advantage of allowing quick replacement of the catalyst should this be necessary. The catalyst may also be present in both a supported and a dissolved form. Any commercially suitable mercaptan oxidation catalyst can be employed. For instance, U.S. Pat. No. 3,923,645 describes a catalyst comprising a metal compound of tetrapyridinoporphyrazine which is preferably retained on an inert granular support. The preferred catalyst is a metallic phthalocyanine such as described in the previously cited references and in U.S. Pat. Nos. 2,853,432, 3,445,380, 3,574,093 and 4,098,681. The metal of the metallic phthalocyanine may be titanium, zinc, iron, manganese, etc. but is preferably either cobalt or vanadium, with cobalt being especially preferred. The metal phthalocyanine is preferably employed as a derivative compound. The commercially available sulfonated compounds such as cobalt phthalocyanine monosulfonate or cobalt phthalocyanine disulfonate are preferred, although other mono-, di-, tri-, and tetra-sulfo derivatives could be employed. Other derivatives including carboxylated derivatives, as prepared by the action of trichloroacetic acid on the metal phthalocyanine, can also be used if desired in the subject process.

When the catalyst is used in its supported form, an inert absorbent carrier material is employed. This material may be in the form of tablets, extrudates, spheres, or randomly shaped naturally occurring pieces. An 8×20 mesh material is highly suitable. Natural materials such as clays and silicates or refractory inorganic oxides may be used as the support material. The support may therefore be formed from diatomaceous earth, kieselguhr, kaolin, alumina, zirconia, etc. It is especially preferred that the catalyst comprises a carbon-containing support, particularly charcoals which have been thermally and/or chemically treated to yield a highly porous structure similar to activated carbon. The active catalytic material may be added to the support in any suitable manner, as by impregnation by dipping, followed by drying. The catalyst may also be formed in-situ within the oxidation zone as described in the cited references. The finished catalyst preferably contains from about 0.1 to about 10 wt. % of a metal phthalocyanine. The solid or supported catalyst may comprise the only contact material which fills the central portion of the vessel or may be admixed with other solids.

In the preferred form of the sweetening process, an aqueous alkaline solution is admixed with the sour feed stream and air and the admixture is then passed through a fixed bed of the oxidation catalyst. The preferred alkaline reagent comprises a solution of an alkaline metal hydroxide such as sodium hydroxide, commonly referred to as caustic, or potassium hydroxide. Sodium hydroxide can be used in concentrations of from about 1 to 40 wt. %, with a preferred concentration range being from about 1 to about 25 wt. %. Any other suitable alkaline material may be employed if desired. The preferred rate at which the alkaline solution is passed into the vessel will depend on such factors as the composition of the feed. The flow rate of the alkaline solution may be as high as 15 vol. percent of the feed hydrocarbon. Alternatively, only small amounts may be charged on an intermittent basis to maintain catalyst activity. The rate of oxygen addition is set based on the mercaptan content of the sour feed hydrocarbon stream. The rate of oxygen addition is preferably greater than the amount required to oxidize all of the mercaptans contained in the feed stream, with oxygen feed rates of about 110 to about 220% of the stoichiometrically required amount being preferred.

The use of a packed bed contacting zone is required in all variations of the subject process to provide quiescent admixture of the reactants for a definite residence time. A small amount of mechanical devices such as perforated plates or channeled mixers can also be used in conjunction with the contacting bed, but the use of apparatus other than an inlet distributor is not preferred. Contact times in the oxidation zone are generally chosen to be equivalent to a liquid hourly space velocity based on hydrocarbon charge of about 1 to 70 or more. A contacting time within the fixed bed in excess of 1 minute is desired. The sweetening process is generally performed at ambient (atmospheric) or slightly elevated temperatures. A temperature above about 50° F. and below about 300° F. is preferred. The pressure in the contacting zone is not critical but is generally elevated to the extent necessary to prevent vaporization of the hydrocarbons and to achieve the solution of added oxygen and nitrogen into the hydrocarbons. The oxidation zone may be successfully operated at low pressures including atmospheric pressure. However, the subject process is directed to hydrocarbons having significant mercaptan contents and which therefore require substantially elevated pressures to achieve the desired gas solubility. For this reason, an elevated pressure above 150 psig is preferred. Higher pressures up to 1000 psig or more can be employed, but increase the cost of the process and are not preferred unless required to promote liquid phase conditions.

I claim as my invention:

1. A process for sweetening hydrocarbon streams to reduce the concentration of mercaptan compounds contained therein which comprises the steps of:

(a) forming a reaction zone charge stream by admixing a liquid phase hydrocarbon feed stream which comprises a mercaptan with an oxygen supply stream and with a liquid phase first aqueous stream which comprises an alkaline reagent and soluble oxidation catalyst;

(b) passing the reaction zone charge stream downward through a fixed mass of contact material located within a vertically oriented vessel at oxidation-promoting conditions, the mass of contact material extending from an upper portion of the vessel downward to at least the lowermost quarter of the vessel;

(c) separating the liquids flowing downward through the mass of contact material in the lowermost quarter of the vessel by a method which comprises withdrawing the liquids through a vertical porous wall into an annular separation zone which is located in the lower portion of the vessel and surrounds the lower portion of the mass of contact material, and decanting the liquids into a hydrocarbon phase comprising disulfide compounds which rises into an open-bottomed covered volume, which is located above the porous wall and separated by impervious upper and side walls from the mass of contact material, and an aqueous phase comprising the alkaline reagent which settles to the bottom of the vessel;

(d) withdrawing a treated hydrocarbon product stream from the open-bottomed volume, and withdrawing a second aqueous stream from the lower portion of the vessel; and (e) employing at least a portion of the second aqueous stream as the previously referred to first aqueous stream.

2. The process of claim 1 further characterized in that the hydrocarbon feed stream has an initial boiling point below about 430° F.

3. The process of claim 2 further characterized in that the oxidation catalyst comprises a phthalocyanine compound.

4. The process of claim 3 further characterized in that the mass of contact material comprises a bed of relatively inert solid particulate material.

5. The process of claim 4 further characterized in that the annular separation zone does not contain solid particulate material.

6. The process of claim 5 further characterized in that the solid particulate material comprises a charcoal.

7. The process of claim 6 further characterized in that the flow rate of the aqueous stream is less than 15 volume percent of the flow rate of the feed stream.

8. A process for reducing the concentration of mercaptan compounds in a hydrocarbon stream which comprises the steps of:

(a) contacting a liquid phase hydrocarbon feed stream which comprises mercaptans, a liquid phase first aqueous stream which comprises an alkaline reagent, and an oxygen supply stream in the presence of an oxidation catalyst in a fixed bed of contact material maintained at oxidation-promoting conditions and located within a vertically aligned vessel, the liquids flowing cocurrently downward through the bed of contact material from an upper portion of the vessel to a point in the lower one-third of the vessel;

(b) separating the liquids which have passed downward through the bed of contact material by a method which comprises passing at least the hydrocarbonaceous portion of the liquids horizontally through a porous vertical screen encircling a lower portion of the bed of contact material into a quiescent separation zone located in the bottom one-third of the vessel with the liquids dividing into an aqueous phase and a less dense hydrocarbon phase, which is collected in an open-bottomed chamber forming the top of the separation zone;

(c) withdrawing a treated hydrocarbon product stream comprising disulfide compounds from the separation zone;

(d) withdrawing a second aqueous stream at a point in the vessel below the open-bottomed chamber; and, (e) recycling at least a portion of the second aqueous stream into the vessel for use as the previously referred to liquid phase first aqueous stream.

9. The process of claim 8 further characterized in that an oxidation catalyst is present in the aqueous stream.

10. The process of claim 7 further characterized in that the catalyst comprises a phthalocyanine compound.

11. The process of claim 10 further characterized in that the catalyst comprises a metal phthalocyanine compound.

12. The process of claim 11 further characterized in that the bed of contact material comprises charcoal.

13. The process of claim 12 further characterized in that the separation zone has an annular shape and is located between the inner surface of the vessel and a cylindrical wall, with the lower portion of the cylindrical wall being formed by said porous screen and an upper portion of the cylindrical wall being imperforate.

14. The process of claim 13 further characterized in that a cylindrical volume within the cylindrical wall is filled with contact material, and the bed of contact material continues upward above the separation zone.

15. The process of claim 14 further characterized in that the hydrocarbon feed stream has an initial boiling point below about 430° F.

16. The process of claim 15 further characterized in that the oxygen supply stream is air and is charged to the process at a rate below the remaining gas solution capacity of the hydrocarbon feed stream.

* * * * *